US008205627B2

(12) United States Patent
Zhou

(10) Patent No.: US 8,205,627 B2
(45) Date of Patent: Jun. 26, 2012

(54) QUICK FOLDING STRUCTURE FOR A POST UNIT OF A TENT FRAME

(75) Inventor: Nanqing Zhou, Fujian (CN)

(73) Assignee: Qyield (Xiamen) Camping Products Co., Ltd., Xiamen, Fujian (CN)

( * ) Notice: Subject to any disclaimer, the term of this patent is extended or adjusted under 35 U.S.C. 154(b) by 0 days.

(21) Appl. No.: 12/344,008

(22) Filed: Dec. 24, 2008

(65) Prior Publication Data

US 2010/0006130 A1 Jan. 14, 2010

(30) Foreign Application Priority Data

Jul. 9, 2008 (CN) ..... 2008 2 0103026 U

(51) Int. Cl.
*E04H 15/60* (2006.01)
*E04H 15/48* (2006.01)

(52) U.S. Cl. ..... 135/114; 135/120.3; 135/136; 135/147

(58) Field of Classification Search ..... 135/123, 135/126, 135, 136, 138, 143, 147, 159, 114, 135/120.3; 403/166
See application file for complete search history.

(56) References Cited

U.S. PATENT DOCUMENTS 4,063,830 A * 12/1977 Ban ..... 403/3
6,776,179 B1 * 8/2004 Chen ..... 135/147

* cited by examiner

*Primary Examiner* — David Dunn
*Assistant Examiner* — Danielle Jackson

(57) ABSTRACT

A quick folding structure for a post unit of a tent frame includes upper, middle and lower posts, an upper connector, and a lower connector. The upper connector is disposed between the upper and middle posts and includes a first upper connecting portion and a second upper connecting portion. The lower connector is disposed between the middle and lower posts and includes a first lower connecting portion and a second lower connecting portion. A wire rope has a first end secured to the first upper connecting portion and a second end connected to a pin. A spring and the pin are disposed in a ladder-shaped trough of the first lower connecting portion. Two ends of the spring engage with the ladder-shaped trough and a first end of the pin, respectively. A second end of the pin faces an engaging notch of the second lower connecting portion.

1 Claim, 8 Drawing Sheets

QUICK FOLDING STRUCTURE FOR A POST UNIT OF A TENT FRAME

BACKGROUND OF THE INVENTION

1. Field of the Invention

The present invention claims the foreign priority filing date Jul. 9, 2008 of CN 200820103026.9, and relates to a tent frame.

2. Description of the Prior Art

There are many types of tents on the market. As shown in FIG. 1, a conventional tent comprises a tarpaulin 1' and a support frame 2' to sustain the tarpaulin 1'. The support frame 2' is composed of a number of post units 21' pivoted to a connecting member 22' at the top of the tent. Each post unit 21' is composed of a number of posts connected with each other. For the time being this type of tent comprises three post units. In order to extend/fold the tent steadily, a connecting member 23' is provided at the joint to connect every two adjacent posts. The connecting member 23' is provided with a fastening 24', as shown in FIG. 2, to secure the two extendable posts, preventing the tent from collapse. The fastening 24' comprises a lock buckle 241' and an engaging groove 242' to cooperate with each other. However, the fastening 24' at each joint of the post unit 21' is independent. When the user wants to extend/fold the tent, he/she must operate each joint. This is very inconvenient in operation. Once one of the independent fastenings is unstable, the tent will collapse.

In addition, FIG. 1 is a small-sized tent. It is still accomplished to fold/extend the tent by operating each joint. For a large-sized tent, it is difficult to operate the higher joints.

Accordingly, the inventor of the present invention has devoted himself based on his many years of practical experiences to the development of a new tent frame.

SUMMARY OF THE INVENTION

The primary objective of the present invention is to provide a quick folding structure for a post unit of a tent frame, which drives posts of each post unit to fold quickly.

According to the present invention, there is provided quick folding structure for a post unit of a tent frame, the post unit comprising upper, middle and lower posts, an upper connector, and a lower connector, the upper connector being disposed between the upper and middle posts and comprising a first upper connecting portion and a second upper connecting portion to engage with each other, the lower connector being disposed between the middle and lower posts and comprising a first lower connecting portion and a second lower connecting portion to engage with each other, a wire rope having a first end and a second end, the first end of the wire rope being secured to the first upper connecting portion and located externally to the upper connector, the second end of the wire rope being connected to a pin, a spring and the pin disposed in a ladder-shaped trough of the first lower connecting portion, two ends of the spring engaging with the trough comprising a series of parallelly oriented subdivided-troughs and a first end of the pin, respectively, a second end of the pin facing an engaging notch of the second lower connecting portion.

The wire rope is used to connect the upper and lower connectors of the post unit. The lower connector is firmed by the engagement of the pin and the engaging notch. The upper connector is tightened by the wire rope. When the user wants to fold the tent, he/she only pulls the top of the tent downward such that the upper connectors of all the post units are disengaged and the lower connectors are also disengaged to complete the folding of the tent. When the user wants to extend the tent, he/she just pushes the top of the tent upward such that the posts of all post units are extended, the pin at the lower connector is urged by the spring to engage with the engaging notch and to drive the wire rope to tighten the upper post so as to support the tent. The aforesaid post units and the operation only need a motion to extend or to fold the tent. This is a convenient and quick operation, particularly for a large-sized tent, without the necessity of operating each connector.

DETAILED DESCRIPTION OF THE PREFERRED EMBODIMENTS

Figure 1:
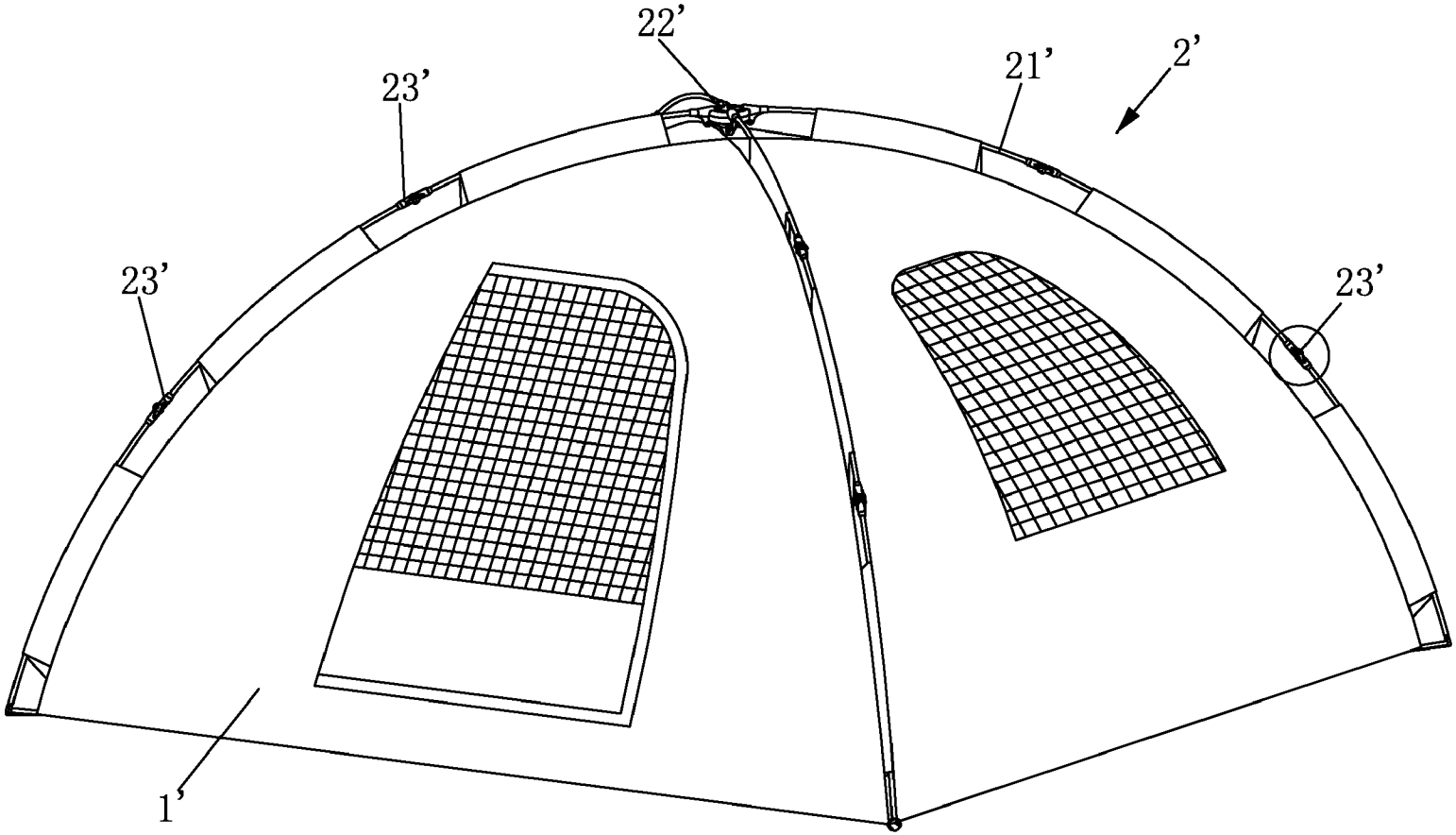
FIG. 1 Prior Art
FIG. 1 is schematic view of a conventional tent.
Figure 2:
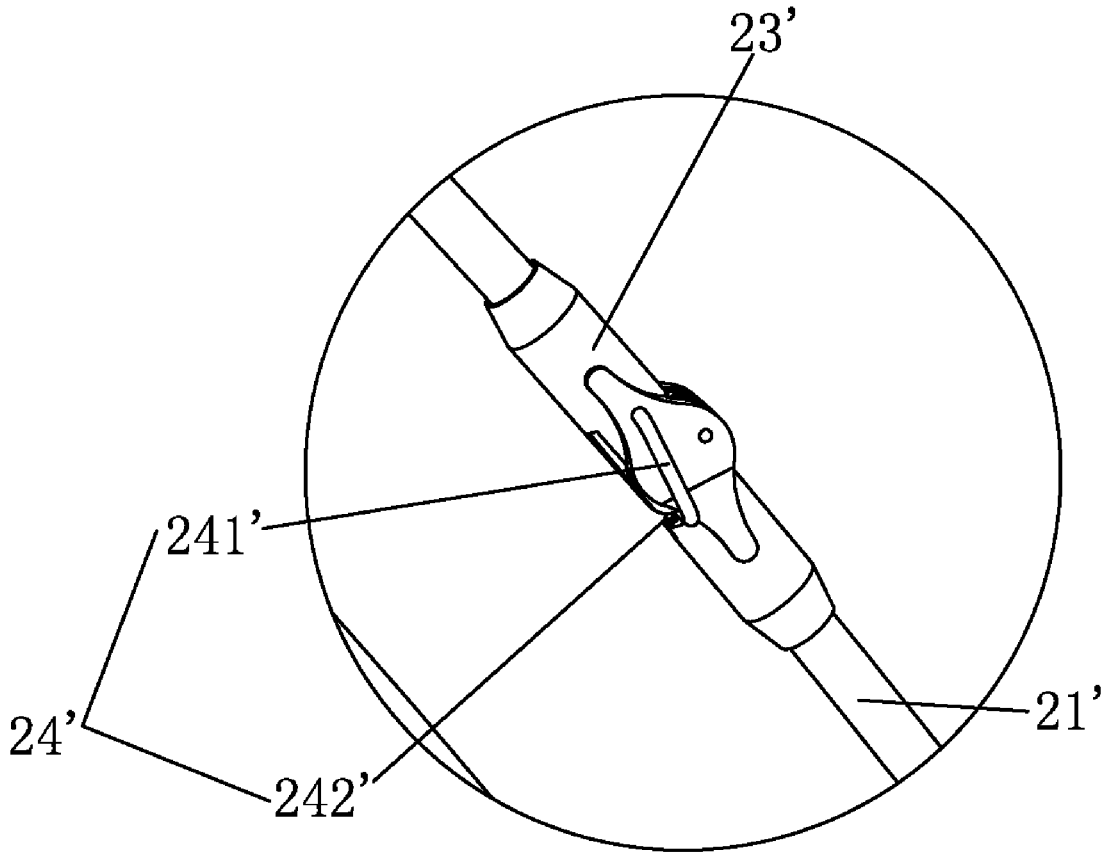
FIG. 2 Prior Art
FIG. 2 is a partially enlarged view of FIG. 1.
Figure 3:
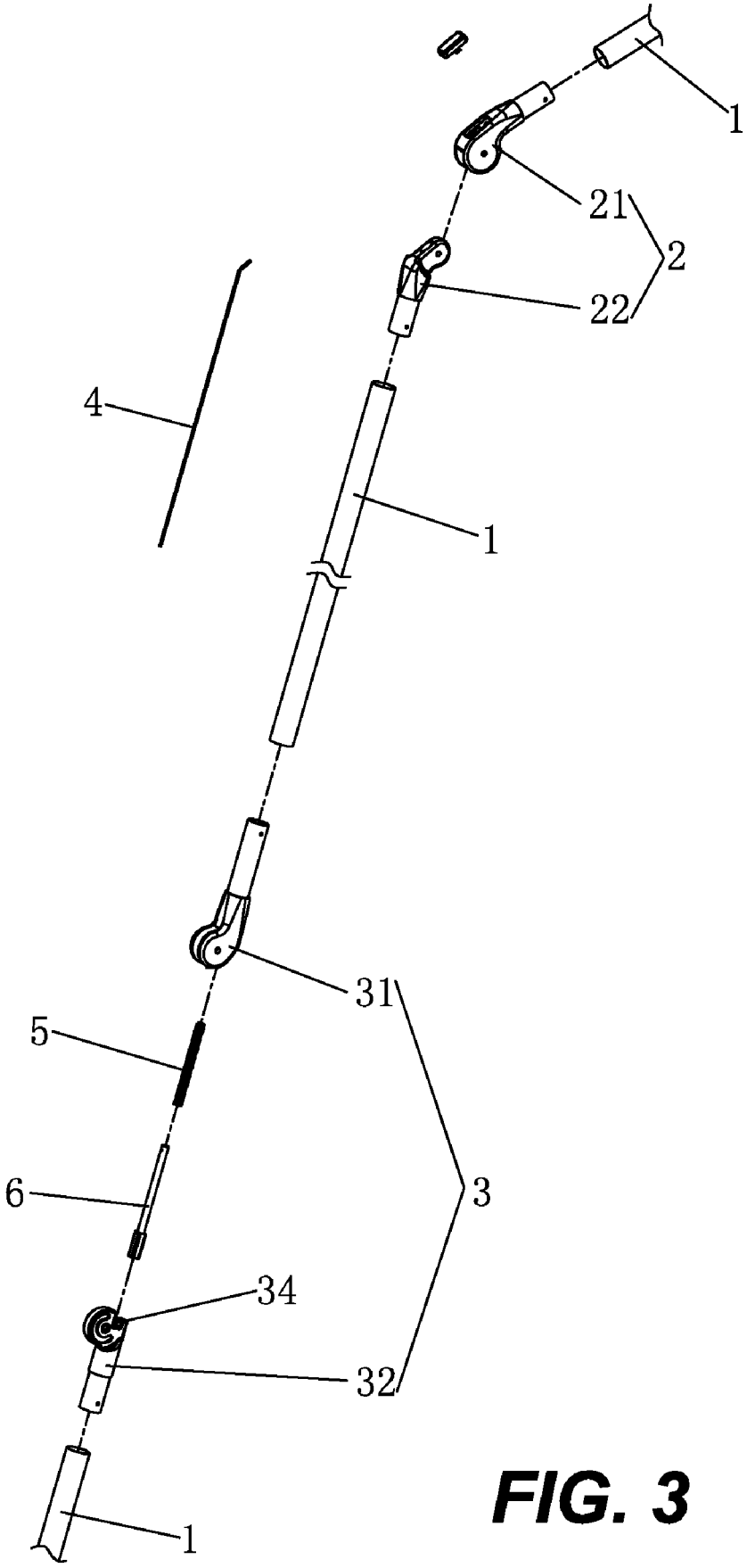
FIG. 3 is an exploded view of the present invention.

Embodiments of the present invention will now be described, by way of example only, with reference to the accompanying drawings.

As shown in FIGS. 3, 4, 4A and 4B, a tent frame is composed of a number of post units. Each of the post units comprises three (upper, middle, lower) posts 1, an upper connector 2, a lower connector 3, a wire rope 4, a spring 5, and a pin 6.

The upper connector 2 is disposed between the upper and middle posts 1, and comprises a first upper connecting portion 21 and a second upper connecting portion 22 to engage with each other.

The lower connector 3 is disposed between the middle and lower posts 1, and comprises a first lower connecting portion 31 and a second lower connecting portion 32 to engage with each other. The first lower connecting portion 31 is formed with a trough 33. The second lower connecting portion 32 is formed with an engaging notch 34 at an end opposite to the first connecting portion 31.

The wire rope 4 has a first end and a second end. The first end is secured to the first upper connecting portion 21 and located at an outer side of the upper connector 2. The second end is connected to the pin 6.

The spring 5 and the pin 6 are disposed in the trough 33 of the first lower connecting portion 31. Two ends of the spring 5 engage with the stairs of the trough 33 and one end of the pin 6, respectively. The other end of the pin 6 faces the engaging notch 34 of the second lower connecting portion 32.

Figure 4:
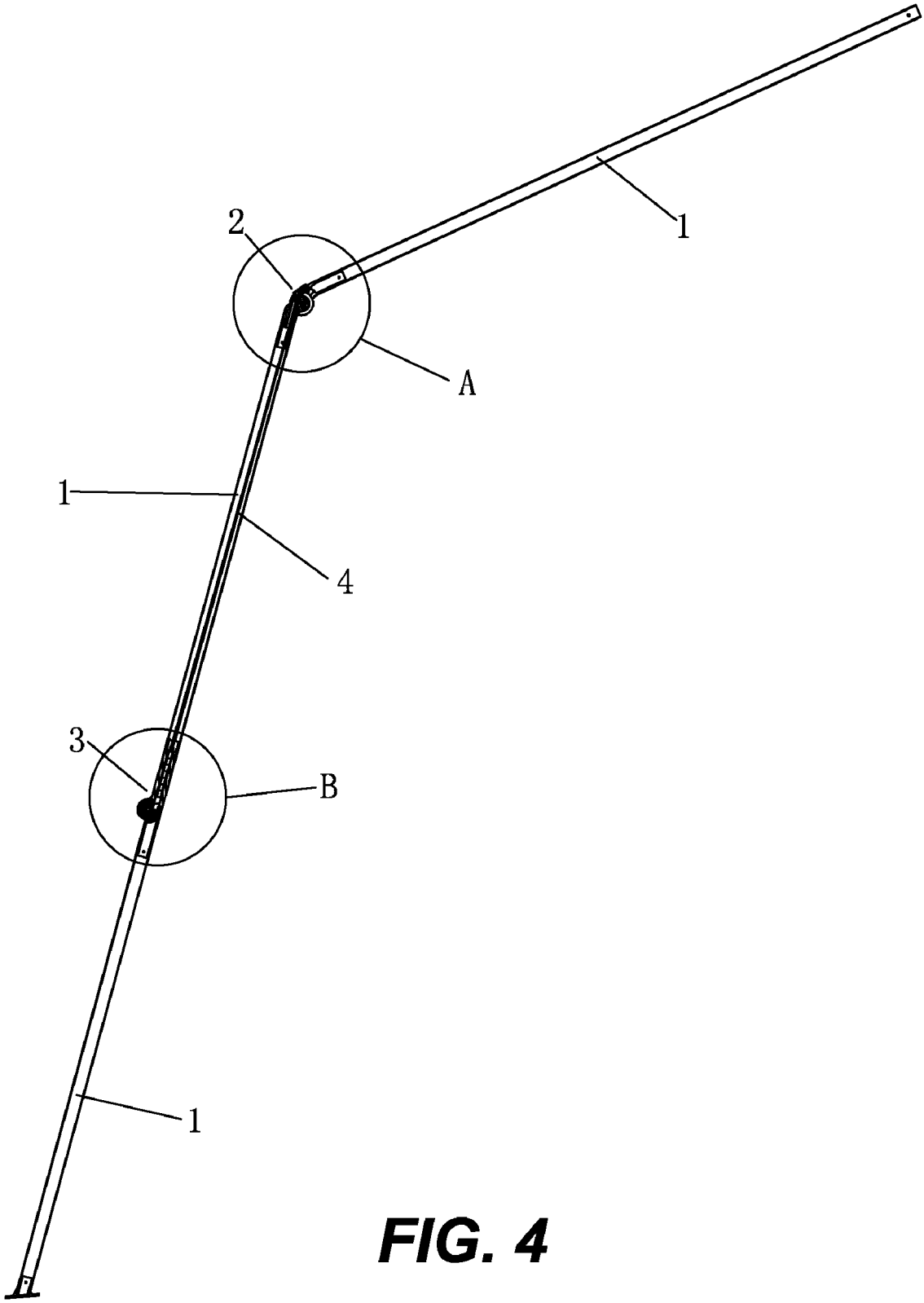
FIG. 4 is a schematic view of the present invention in an extended state.
Figure 4A:
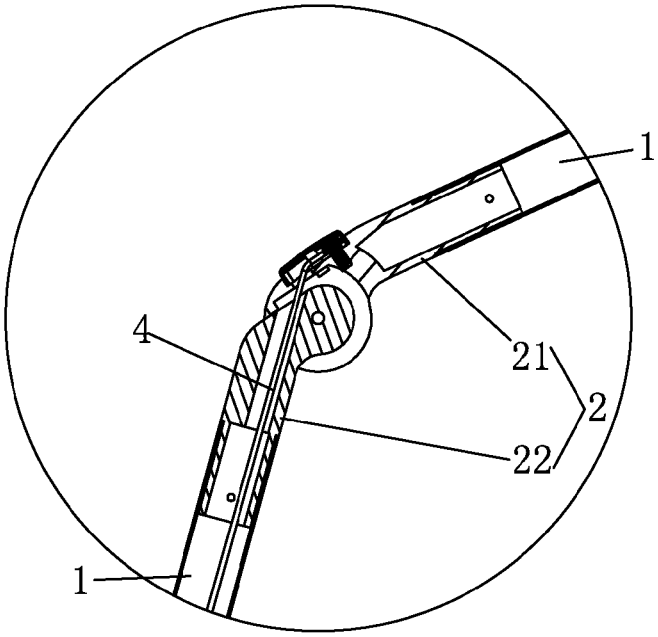
FIG. 4A is an enlarged view taken from circle A of FIG. 4.
Figure 4B:
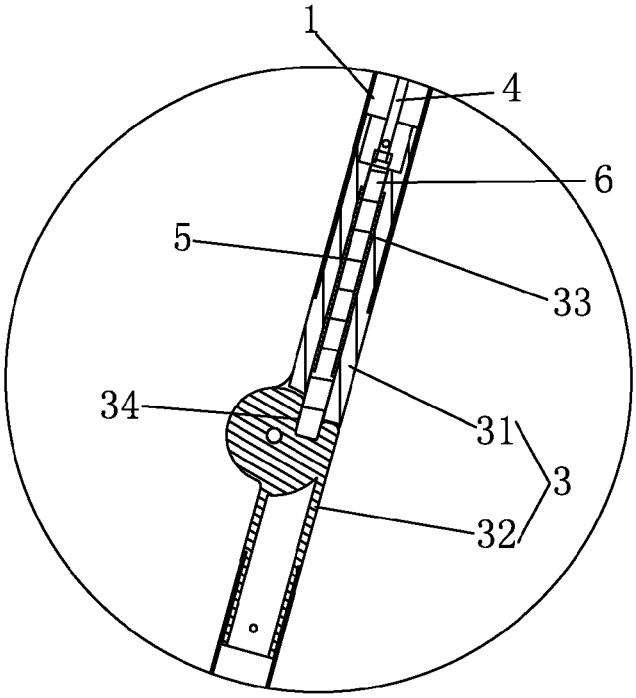
FIG. 4B is an enlarged view taken from circle B of FIG. 4.
Figure 5:
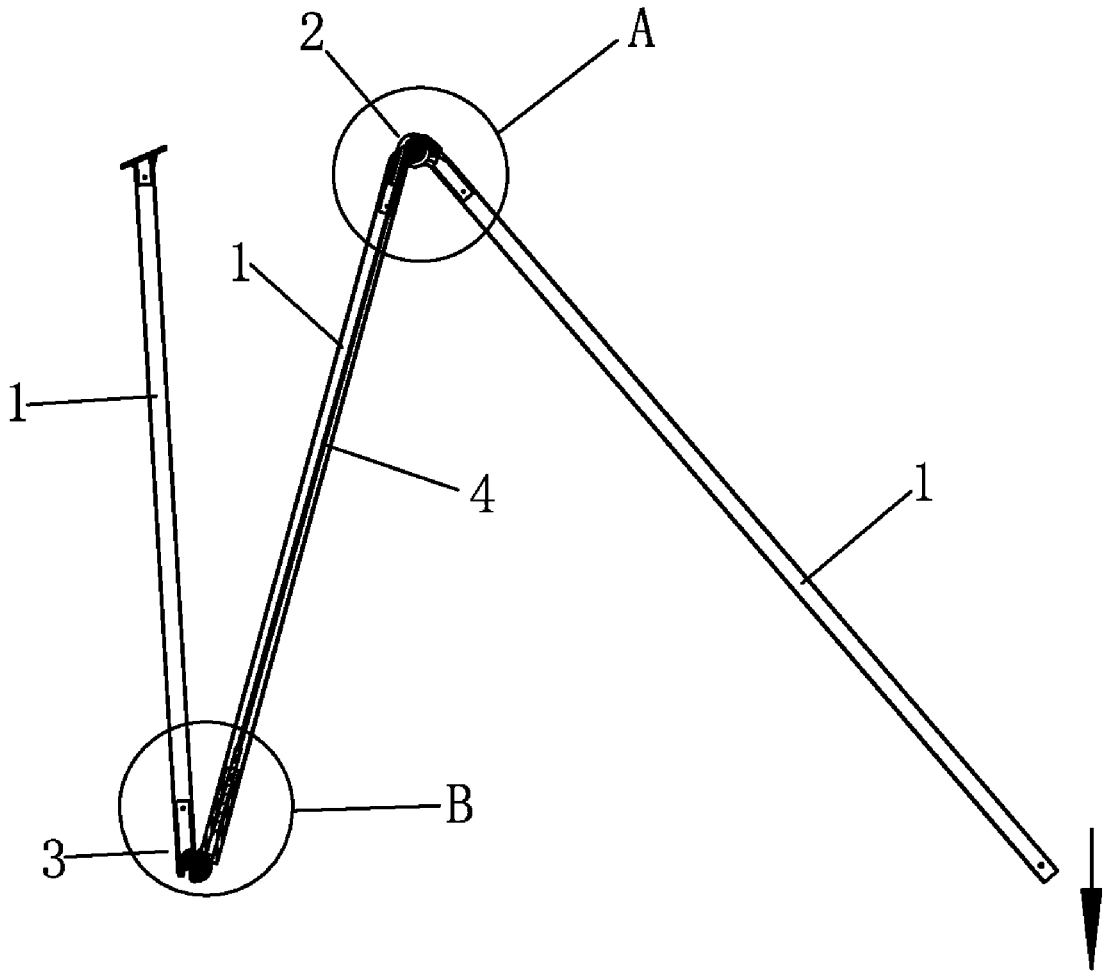
FIG. 5 is a schematic view of the present invention in a folded state.
Figure 5A:
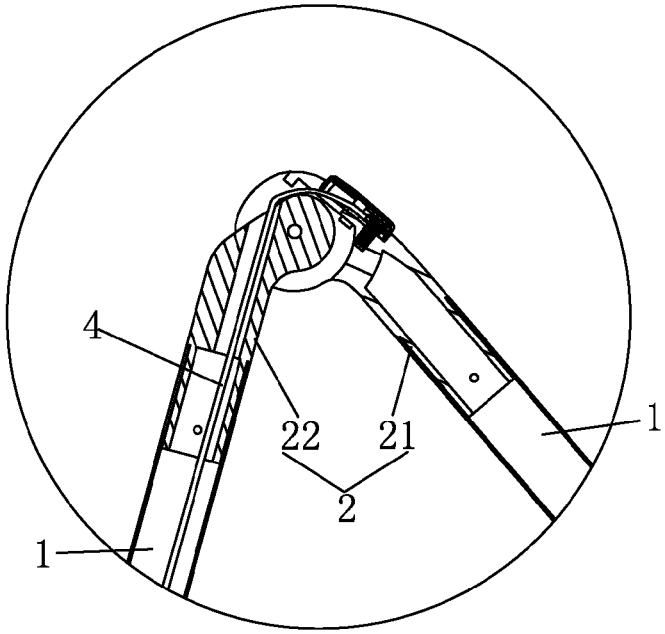
FIG. 5A is an enlarged view taken from circle C of FIG. 5.
Figure 5B:
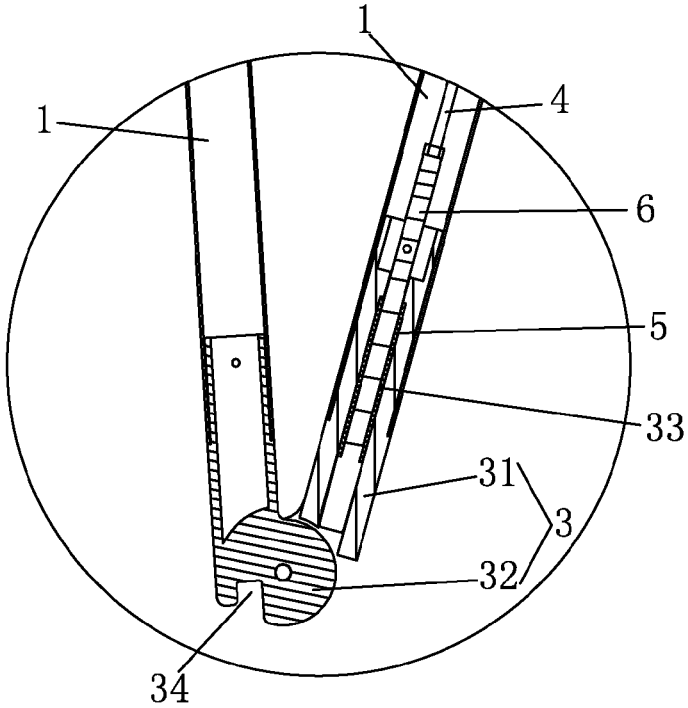
FIG. 5B is an enlarged view taken from circle D of FIG. 5.
Figure 6:
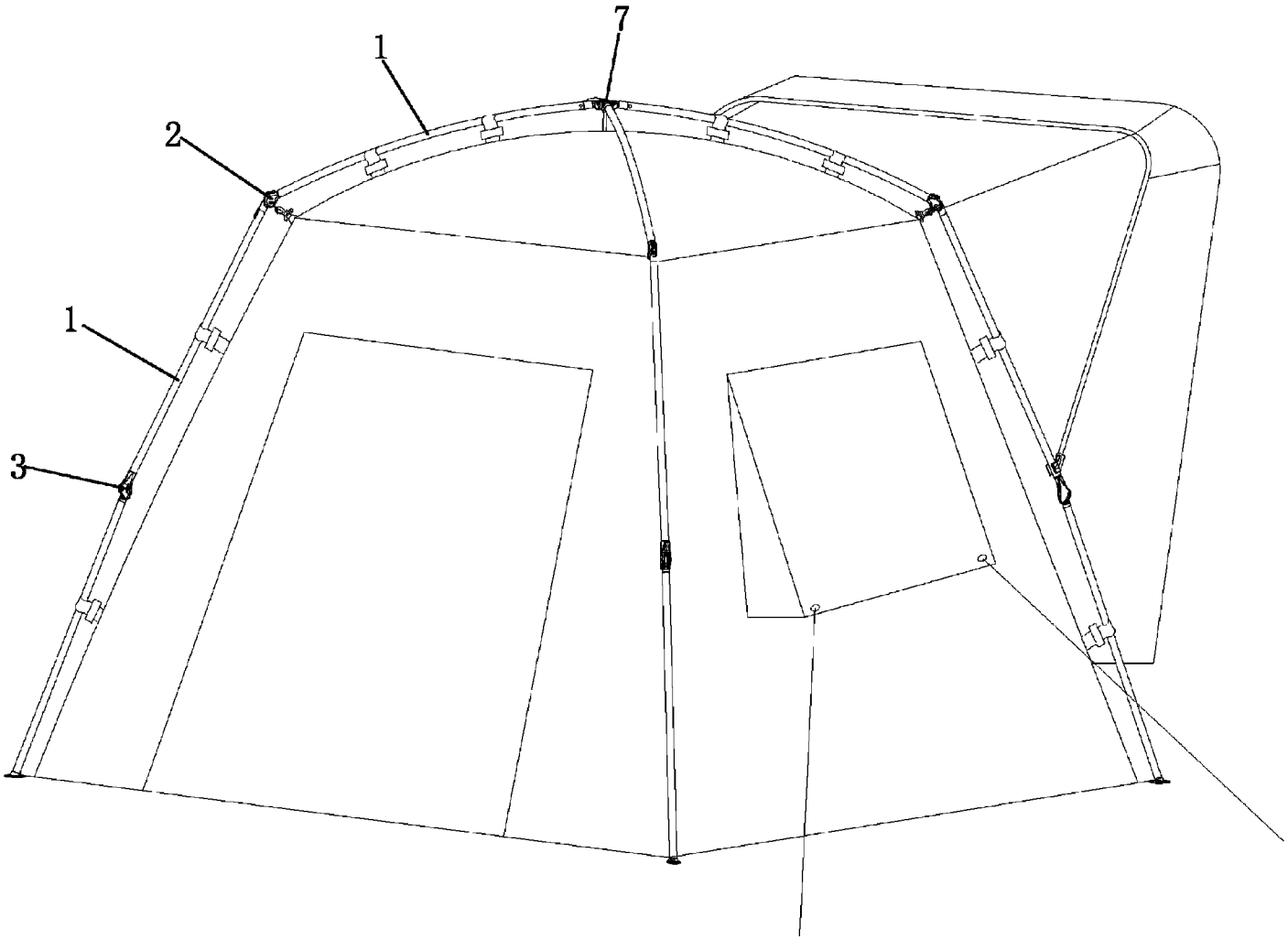
FIG. 6 is a schematic view showing the present invention in use.

Referring to FIGS. 4, 4A and 4B, when the present invention is extended, the pin 6 will be urged by the spring 5 to engage with the engaging notch 34 of the second lower connecting portion 32, preventing the two connecting portions of the lower connector 3 from rotating with each other, while the pin 6 will pull the wire rope 4 downward such that the upper end of the wire rope 4 tightens the first upper connecting portion 21, preventing the two connecting portions of the upper connector 2 from rotating with each other. Thus, the extended frame is able to support the tent steadily, as shown in FIG. 6.

As shown in FIGS. 5, 5A, 5B and 6, when the tent is folded, a connecting member 7 provided on the top of the tent will be pulled downward to bring the first upper connecting portion 21 to turn downward and drive the wire rope 4 such that the pin 6 connected with the lower end of the wire rope 4 compresses the spring 5 and disengages from the engaging notch

34 of the second lower connecting portion 32. The aforesaid operation is achieved by pulling downward the tope of tent to drive the wire ropes 4 of all the post units so that each post unit is in a disengaged state. After that, the lower post 1 is folded upward and inward. This is a convenient and quick way to fold the tent.

When the tent is extended, the top of the tent will be pushed upward to extend all the posts of each post units. The pin 6 of each post unit is urged by the spring 5 to engage with the engaging notch 34 of the second lower connecting portion 32, while the wire rope 4 tightens the first upper connecting portion 21 to extend the tent securely, as shown in FIG. 4. The connecting member 7 is connected with the top of each post unit (This structure is not the feature of the present invention, and doesnît be described hereinafter.) to support the whole tent.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A quick folding structure for a post unit of a tent frame, comprising i) upper, middle and lower posts, ii) an upper connector, disposed between the upper and middle posts, comprising ii.A) a first upper connecting portion, further including a partially spherical $1^{st}$ upper head, and a non-spherical $1^{st}$ upper tail extended and connected with said upper post, and ii.B) a second upper connecting portion, further including a partially spherical $2^{nd}$ upper head received by the partially spherical $1^{st}$ upper head, and a non-spherical $2^{nd}$ upper tail extended and connected with said middle post, and iii) a lower connector, disposed between the middle and lower posts, comprising iii.A) a first lower connecting portion, further including a partially spherical $1^{st}$ lower head, and a non-spherical $1^{st}$ lower tail extended and connected with said middle post, and a trough, and iii.B) a second lower connecting portion, including a partially spherical $2^{nd}$ lower head received by the partially spherical $1^{st}$ lower head, and a non-spherical $2^{nd}$ lower tail extended and connected with said lower post, wherein a wire rope including a first end and a second end, the first end of the wire rope connected to an internal portion of the partially spherical first upper head, the second end of the wire rope connected to a pin, a spring and the pin are both disposed in the trough of the first lower connecting portion, and a second end of the pin facing an engaging notch of the second lower connecting portion.

* * * * *